United States Patent [19]

Fehér et al.

[11] Patent Number: 4,733,338

[45] Date of Patent: Mar. 22, 1988

[54] ILLUMINATOR, PARTICULARLY FOR STREET LIGHTING AND INDUSTRIAL APPLICATIONS

[75] Inventors: Zoltán Fehér; Miklós Csapody; Károly Jermendy; András Szeverényl, all of Budapest, Hungary

[73] Assignee: Tungsram Reszvenytarsasag, Budapest, Hungary

[21] Appl. No.: 913,721

[22] Filed: Sep. 30, 1986

[30] Foreign Application Priority Data

Oct. 1, 1985 [HU] Hungary ..... 3792/85

[51] Int. Cl.[4] ..... F21V 7/00

[52] U.S. Cl. ..... 362/310; 362/347; 362/297; 362/296

[58] Field of Search ..... 362/310, 296, 297, 304, 362/347

[56] References Cited

U.S. PATENT DOCUMENTS

| | | | |
|---|---|---|---|
| 2,418,131 | 4/1947 | Margolis | 362/296 X |
| 4,420,801 | 12/1983 | Reiling et al. | 362/310 X |
| 4,437,145 | 3/1984 | Roller et al. | 362/310 X |
| 4,539,628 | 9/1985 | Bartenbach | 362/297 |
| 4,544,998 | 10/1985 | Shanko | 362/310 X |

*Primary Examiner*—Larry Jones

*Attorney, Agent, or Firm*—Michael N. Meller

[57] ABSTRACT

An illuminator, particularly for street lighting and industrial applications, comprising a light source including a gas discharge tube, a closed outer vessel for receiving the gas discharge tube, composed from a rear half part and a front half part for forwarding light of the light source, at least the front half part made of light transparent material, light reflecting means covering partly the inner surface of the rear half part of the outer vessel, mechanical fitting elements and electric connecting means, wherein the front half part and the rear half part both are symmetric to at most two symmetry planes and one of the symmetry planes includes the longitudinal axis of the gas discharge tube and constitutes the symmetry plane of the light emitted by the light source. The proposed illuminator require small place and is hardly subject to contamination originated from the environment.

20 Claims, 5 Drawing Figures

ILLUMINATOR, PARTICULARLY FOR STREET LIGHTING AND INDUSTRIAL APPLICATIONS

BACKGROUND OF THE INVENTION

The invention refers to an illuminator, particularly for street lighting and industrial applications, based on a gas discharge tube which is enclosed in an outer vessel made of light transparent material, e.g. hard glass, and comprising light reflecting surfaces.

The gas discharge tubes characterized by high light efficiency and long lifetime have found many applications in street lighting and in industry. The illuminators applied for street lighting are generally arranged on the end of respective standards which extend as high as possible in order to ensure a light distribution as homogeneous as possible on a relatively long street section. This is possible by satisfying the requirement that the light distribution characteristics be shaped as a double fan. The desired characteristics can be ensured by mirrors arranged behind the light source and by horizontal or slightly declined arrangement of the illuminator axis. The illuminators of this kind can be represented e.g. by the illuminator sold under the type No. KRT-70 produced by the firm EL-CO Villamos Keszülekek es Szerelesi Anyagok Gyara (Budapest, Hungary).

To date, the illuminators applied for street lighting have light sources of significantly shorter lifetime than the housing applied for receiving the light source. This means that the housing should by capable of bearing one or more replacements of the light source.

The illuminators of that kind are exposed to the deposition of dust and other contaminants originated from the atmosphere. The deposit, which diminishes the light efficiency of the illuminator, is slowly formed on the inner and outer surfaces. An outer housing without sealing cannot improve the conditions because of the small openings and rifts which are always present. Through the openings and rifts the air can flow into the inner space of the vessel, carrying dust and other solid or aerosol particles into the inner space. The temperature conditions vary in the environment of the light source in the inner space, which results in depositing various quantities of solid or solidified components in different places.

The light crossing the housing of the known illuminators suffers high intensity loss because of the presence of two deposit layers (dust layers), at least. The dust layers on the surface of the light source and on the outer and inner surfaces of the vessel can cause a great deterioration of the light efficiency.

A further disadvantage of the known constructions follows from the fact that the light emitting and light reflecting means can be subject to a displacement during assembly and to other mechanical influencing factors. The fine adjustment of the mirrors can be deteriorated by the transport and handling of the illuminator.

It is well known to apply in the illuminator for street lighting common units for mechanical fitting and electrical connecting of the light source. For this object generally standardized threaded fittings (sockets) are applied. The threaded fittings require a relatively large space for their arrangement; sometimes the requirements of high accuracy of mechanical placing and high reliability of electrical contact are in conflict. A compromise can often be found solely by further increasing the mechanical dimensions.

It is known to prepare illuminators having an outer vessel made of hard glass. The illuminators of such kind require no outer housing because of the advantageous features of the glass. The glass can bear the intensive load of the free air applications. The problem is, however, that for realizing the required light distribution characteristics a mirror should be arranged behind the light source and this mirror is subject to different damaging influences in particular, it is practically barely protected against the atmospheric exposures. This is the reason why the mentioned illuminators lacking an outer housing but requiring outer light reflecting means have not found wide application.

The inner reflecting layers applied on the glass vessel of an illuminator are often applied in illuminators intended for use in interiors, wherein the contamination load is low. In these illuminators, however, the reflecting layers are applied in a rotational symmetry arrangement around the light emitting element (incandescent body, gas discharge tube) and the light is emitted along the longitudinal axis of the light emitting element.

In illuminators when applied for street lighting the gas discharge tubes as light sources should be arranged in a manner so as to project the direct light perpendicularly toward the mantle of the tube, and into the space to be lighted.

SUMMARY OF THE INVENTION

The object of the invention is to provide an illuminator, particularly for application in street lighting and in industry, ensuring improved light efficiency and time stability and having a smaller entire volumen than the known solutions.

The invention is based on the recognition that nowadays the production technology of the light sources can offer gas discharge lamps having a lifetime as long as that of the traditional mechanical and optical constructions. The gas discharge tubes of such long lifetime enable a revision of the design principles applied to date and a compaction of the light source with the mechanical, optical elements arranged separately in the known solutions.

A single compact unit can be formed when the light source is completed with a reflecting mirror or layer arranged in the inner space of the outer vessel. This is the way of creating the necessary light distribution characteristics. It is also very important to revise the known rotational symmetry constructions and to select another shape, and further, to separate the mechanical fitting and the electric current inlet elements. These objects can be attained without any trouble with respect to the high lifetime of the light source and they render other constructional advantages also possible.

The proposed illuminator, particularly for street lighting and industrial applications, comprises a light source with at least one gas discharge tube, an outer vessel receiving the gas discharge tube and made of a light transparent material, e.g. hard glass, a light reflection layer prepared in the inner space of the vessel, mechanical fitting means and electric inlet elements, wherein the outer vessel consists of a front half part and a rear half part united to each other, the front half part and the rear half part being symmetric with respect to at most two symmetry planes, respectively, and one of the symmetry planes comprising the longitudinal axis of the gas discharge tube and being the symmetry plane of the light emission. The mentioned axis covers a middle line of the proposed illuminator or is parallel therewith.

In the rear half part it is advantageous to apply two concave hollow spaces connected to a central rib arranged along the middle line lying in the symmetry plane. The current inlet elements are connected from the gas discharge tube to the rear half part and the contact wires forming these elements are led through the rear half part.

In order to facilitate the mechanical fitting operations, it is advantageous to apply three fitting supports made in the rear half part near to the surface of connection of the half parts, wherein the surface of connection is generally a straight plane.

In the plane of connecting the half parts it is advantageous to shape the half parts with a rectangular cross section with rounded corners, wherein the radius of curvature of the half parts in sections lying perpendicular to the plane of connection is smaller than that of their cross section forming a part of a plane perpendicular to the latter.

BRIEF DESCRIPTION OF THE DRAWING

The invention will further be described with reference to advantageous embodiments and reference to the accompanying drawings. In the drawings

DESCRIPTION OF THE PREFERRED EMBODIMENTS

Figure 1:
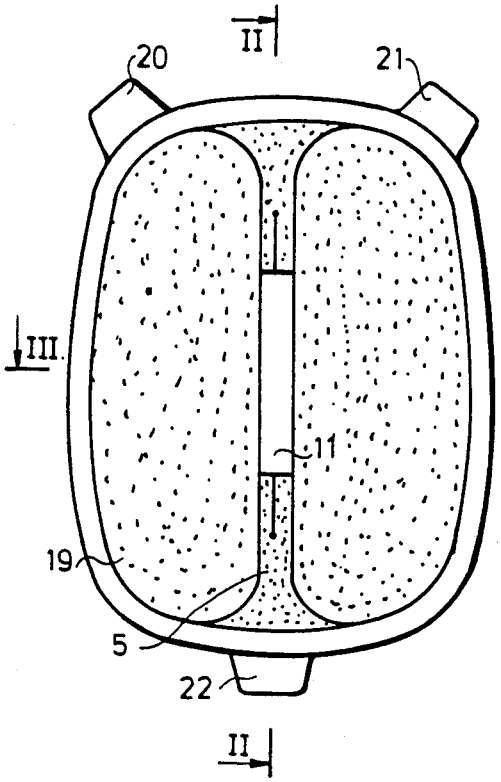
FIG. 1 is a top view of an illuminator according to the invention.
Figure 2:
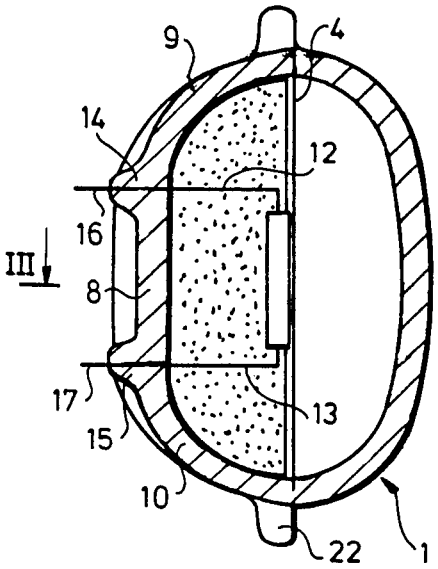
FIG. 2 is a cross section of the proposed illuminator taken along a symmetry plane II—II.
Figure 3:
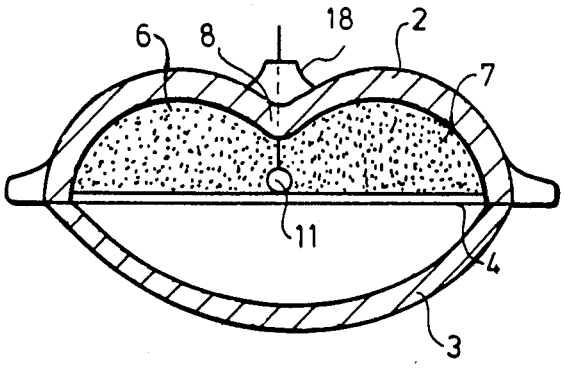
FIG. 3 is another cross section of the proposed illuminator taken along a further symmetry plane III—III lying perpendicular to the symmetry plane II—II.

The illuminator according to the invention as shown in FIGS. 1 to 3 is equipped with a light transmitting outer vessel 1 consisting of two half parts, i.e. a rear half part 2 and a front half part 3, which are welded to one another along a flange. This flange lies generally in a plane defining a connecting plane 4. It is possible to use a vessel made of hard glass or other appropriate light transmitting material capable of bearing the atmospheric exposures. Both the rear half part 2 and the front half part 3 are symmetric with respect to at least one symmetry plane II—II shown in FIG. 1, and this symmetry plane includes also a middle line 5 defining the plane comprising the longitudinal axis of the illuminator. In the middle line 5 or parallel to it the light source of the proposed illuminator, comprising one or more gas discharge tubes 11, is arranged. It is also advantageous to apply a rear half part 2 and a front half part 3 which are symmetric to another symmetry plane III—III which is perpendicular to the symmetry plane II—II. The symmetry planes II—II and III—III are perpendicular to the connecting plane 4. Both half parts 2, 3 can be made of hard glass, especially borosilicate glass having a low thermal expansion coefficient and high resistance against moisture of atmospheric or other origin. In the rear half part 2 there are two hollow concave spaces 6 and 7, arranged symmetrically with respect to the middle line 5 from the inner space of the outer glass vessel 1. As is clearly shown in FIG. 1, in the connecting plane 4 the rear half part 2 and the front half part 3 have similar almost rectangular cross-sections with rounded corners. FIGS. 2 and 3 show the cross section of the mentioned half parts in planes perpendicular to the connecting plane. The hollow concave spaces 6 and 7 are partly separated by central rib 8. The central rib 8 extends to a wall bending to the connecting plane in outer regions 9 and 10 of the rear half part 2. In this region the hollow concave spaces 6, 7 are not separated in any way, i.e. they form a jointed space.

In the inner space of the outer vessel 1 there is a light source arranged over the central rib 8. This light source, constituted by a single gas discharge tube 11, is connected by electric input means 12 and 13 to an outer electric circuit and lies in a line parallel to the middle line 5. The input means 12 and 13 of the gas discharge tube 11 are connected through wires 14 and 15, made e.g. of tungsten, to connecting means 16 and 17. The wires can be welded to the input means 12 and 13 at one end, and to the connecting means 16 and 17 at the other end. This solution has been found to be the most advantageous. In those parts through which the wires 14 and 15 extend, the rear half part 2 is thicker than in other parts and is provided with a truncated coneshaped stub 18. The cylindrical vessel of the gas discharge tube 11 is generally made of quartz glass or alumina-based ceramics. The gas discharge tube 11 can be a metal halogenide lamp or a high-pressure sodium vapor lamp constructed and produced in a known embodiment. The rear half part 2 is covered practically on its entire inner surface by a reflecting layer 19—shown in FIGS. 1 to 3 by dots—made in a known way, e.g. by depositing aluminum vapor. The hazardous step during the production of the proposed illuminator is the connecting step when the rear and the front half parts 2 and 3 are united because of the damage which may be done to the reflecting layer 19. This risk can be reduced if the reflecting layer 19 ends near the connecting plane 4, in a line adjacent to this plane.

The fitting of the outer vessel 1 of the proposed illuminator can be realized by means of three supports 20, 21, 22 arranged on the rear half part 2 near the connecting plane 4.

The supports 20, 21, 22 are generally made during the pressing operation for producing the glass vessel 1. They deflect a bit in all directions and this renders simplified fitting operations possible. The supports 20, 21, 22 can define a fixing plane, always ensuring the position of the glass vessel 1 after mounting the illuminator. This is a solution for emitting light with a constant distribution diagram for all illuminators of the same kind.

The length of the discharge tube 11 and the dimension of the hollow concave spaces 6 and 7 should be selected when designing the proposed illuminator and thereby it is possible to obtain a light distribution diagram according to the requirements for the illuminator.

Figure 4:
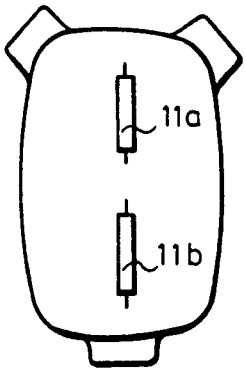
FIG. 4 is a simplified view of an illuminator comprising two gas discharge tubes and FIG. 5 is a light distribution characteristic of an illuminator designed according to the FIGS. 1 to 3.

A further advantageous embodiment of the proposed illuminator can be seen in FIG. 4, wherein the light source comprises two gas discharge tubes 11*a*, 11*b* arranged along the common middle line 5, over the central rib 8. By using two gas discharge tubes, it is possible to improve the color of the emitted light and the light efficiency of the illuminator. For this aim, one of the gas discharge tubes can e.g. be a metal halogenide lamp with a filling containing sodium iodide, indium iodide or thallium iodide, having a color temperature about 4000 K. and color response index $R_a=65$. The power of this tube is e.g. 250 W. Selecting the other gas discharge tube as a high-pressure sodium vapor lamp of 150 W power, color temperature about 2000 K. and color response index $R_a=20$, the light source gives a color temperature of about 3000 K. and a color response index $R_a=50$. The application of two or more gas discharge tubes in the light source offers the possibility of igniting them one after another, or of lighting only some of them, whereby energy savings can be achieved.

In the glass vessel the gas discharge tube 11, 11*a* or 11*b* is placed in a sealed space which is either a vacuum space or a space filled with neutral gases introduced under a pressure lower than one atmosphere. The vacuum can be produced or the neutral gases can be introduced by a stub (not shown here) which should be hermetically sealed after ensuring the required state of the inner space of the illuminator. This technique is per se well known from the production of the gas discharge lamps..

Figure 5:
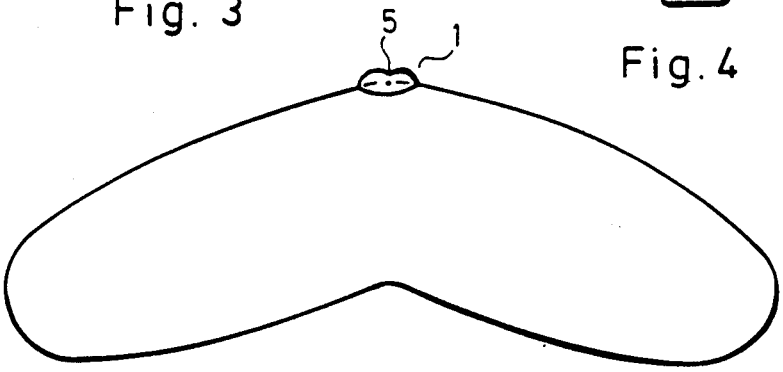

As is shown in FIG. 5, the illuminator according to the invention ensures a characteristic double fan-shaped light distribution diagram. This diagram consists of two fan-shaped parts lying symmetrically with respect to the middle line 5. The light source of the proposed illuminator can ensure the corresponding two light beams giving uniform lighting intensity at the street level.

As compared with the known illuminators comprising gas discharge vessels (tubes) the illuminator of the present invention has many advantageous features. The most important is that the light, after leaving the reflecting layer 19, crosses only one surface exposed to the contaminating influence of the atmosphere. The mirror (reflecting layer 19) is always in the same position, this which position does not depend on the fitting process. The different operations for arranging the illuminator in its desired place can hardly influence the shape or position for the case the light distribution diagram except of rough handling.

The illuminator of the invention requires—because of the mirror arrangement, and the separate mechanical and electric connections—less space than the known types. Its weight is also less and therefore it is possible to apply lighter standards which results in cost and material savings. The connecting means 16 and 17 protruding from the outer vessel 1 can be connected by dissolvable means or by welding to an outer electric circuit supplying voltage to the illuminator. The connection can be as safe as possible and there is no problem with the diminished contacting quality of the threaded fittings. The illuminator of the invention requires no outer housing and only its front half part 3 is exposed to the atmospheric influence.

The illuminator of the invention has been described hereinbefore by way of some examples and it should be understood that the skilled artisan can find many different solutions equivalent to those shown. Therefore the scope of the protection is intended to be defined by the attached claims and not the examples given above.

What we claim is:

1. An illuminator, particularly for street lighting and industrial applications, comprising a light source including a gas discharge tube, a closed outer vessel for receiving said gas discharge tube, said vessel comprising a rear half part and a front half part for forwarding light of said light source, at least said front half part being made of light transparent material, light reflecting means partly covering the inner surface of said rear half part of said outer vessel, mechanical fitting elements and electric connecting means, wherein said front half part and said rear half part are each symmetric relative to first and second symmetry planes and said first symmetry plane includes the longitudinal axis of said gas discharge tube, said longitudinal axis of said gas discharge tube being perpendicular to said second symmetry plane, and said rear half part having a curved profile comprising two concavities in said second symmetry plane and a curved profile comprising one concavity in said first symmetry plane.

2. The illuminator as claimed in claim 1, wherein said gas discharge tube is connected by electric connecting means to said rear half part and said electric connecting means comprises elements led through said rear half part.

3. The illuminator as in claim 2, wherein said rear half part includes two hollow spaces being concave from inside of said outer vessel and connected to one another in a central rib provided along a middle line of said outer vessel lying in said connecting plane.

4. The illuminator as claimed in claim 1, wherein said mechanical fitting elements comprise supports arranged on the outer surface of said outer vessel.

5. The illuminator as in claim 4, wherein said light source includes at least two gas discharge tubes arranged in said symmetry plane.

6. The illuminator as in claim 4, wherein said rear half part includes two hollow spaces being concave from inside of said outer vessel and connected to one another in a central rib provided along a middle line of said outer vessel lying in said connecting plane.

7. The illuminator as claimed in claim 1, wherein said rear half part and said front half part are connected to one another in a connecting plane and have in said connecting plane a rectangular cross-section with rounded corners, the radius of curvature for said cross-section lying parallel to the shorter side of said rectangular shaped cross-section and perpendicular to said connecting plane being less than the radius of curvature in the plane perpendicular to said connecting plane.

8. The illuminator according to claim 7, wherein said rear half part includes two hollow spaces which are concave from inside of said outer vessel and are connected to one another by a central rib provided along a middle line of said outer vessel lying in said connecting plane.

9. The illuminator as in claim 7, wherein said light source includes at least two gas discharge tubes arranged in said symmetry plane.

10. The illuminator as in claim 7, wherein said rear half part includes two hollow spaces being concave from inside of said outer vessel and connected to one another in a central rib provided along a middle line of said outer vessel lying in said connecting plane.

11. The illuminator according to claim 1, wherein said light source includes at least two gas discharge tubes arranged in said first symmetry plane.

12. The illuminator according to claim 11, wherein said center lines of said gas discharge tubes are collinear.

13. The illuminator as in claim 12, wherein said rear half part includes two hollow spaces being concave from inside of said outer vessel and connected to one another in a central rib provided along a middle line of said outer vessel lying in said connecting plane.

14. The illuminator as in claim 11, wherein said rear half part includes two hollow spaces being concave from inside of said outer vessel and connected to one another in a central rib provided along a middle line of said outer vessel lying in said connecting plane.

15. The illuminator according to claim 1, wherein said outer vessel is made of hard glass by pressing.

16. An illuminator, particularly for street lighting and industrial applications, comprising a light source including a first gas discharge tube, a closed outer vessel made at least partly of hard glass by pressing for receiving said first gas discharge tube in a hermetically closed space of less than atmospheric pressure, light reflecting means partly covering the inner surface of said outer vessel, mechanical fitting elements and electric connecting means separated from said mechanical fitting elements, wherein said outer vessel consists of a rear half part for receiving said light reflecting means and a front half part connected to said rear half part along a straight connecting plane, said rear half part and said front half part each being symmetric to a first symmetry plane lying perpendicular to said connecting plane, said first symmetry plane including the longitudinal axis of said first gas discharge tube, said longitudinal axis of said gas discharge tube being perpendicular to said second symmetry plane, and said rear half part having a curved profile comprising two concavities in said second symmetry and a curved profile comprising a single concavity in said first symmetry plane.

17. The illuminator according to claim 16, wherein said rear half part and said front half part are respectively symmetric to a second symmetry plane perpendicular to said first symmetry plane and to said connecting plane.

18. The illuminator according to claim 16, wherein said rear half part includes two hollow spaces which are concave from the inside of said outer vessel and are connected to one another by a central rib provided along a middle line of said outer vessel lying in said connecting plane.

19. The illuminator according to claim 16, wherein said outer vessel consists of hard borosilicate glass and is made by pressing.

20. The illuminator according to claim 16, wherein said light source further includes a second gas discharge tube, said second gas discharge tube being coaxial with said first gas discharge tube.

* * * * *